US010982443B1

(12) United States Patent
Abbas et al.

(10) Patent No.: US 10,982,443 B1
(45) Date of Patent: Apr. 20, 2021

(54) HYBRID POST-INSTALLED ANCHOR FOR CONCRETE

(71) Applicant: KING SAUD UNIVERSITY, Riyadh (SA)

(72) Inventors: Husain Abbas, Riyadh (SA); Tarek H. Almusallam, Riyadh (SA); Eid Shaja Alotaibi, Riyadh (SA); Yousef A. Al-Salloum, Riyah (SA)

(73) Assignee: KING SAUD UNIVERSITY, Riyadh (SA)

( * ) Notice: Subject to any disclaimer, the term of this patent is extended or adjusted under 35 U.S.C. 154(b) by 0 days.

(21) Appl. No.: 16/933,723

(22) Filed: Jul. 20, 2020

(51) Int. Cl.
*E04C 5/12* (2006.01)

(52) U.S. Cl.
CPC ..... *E04C 5/122* (2013.01); *E04C 5/125* (2013.01)

(58) Field of Classification Search
CPC ..... E04C 5/122; E04C 5/125; F16B 13/122; F16B 13/124; F16B 13/128
USPC ..... 52/155, 156, 166, 298, 704, 705, 707, 52/713
See application file for complete search history.

(56) References Cited

U.S. PATENT DOCUMENTS

D28,287 S * 2/1898 Hanline ..... D8/391
805,040 A * 11/1905 Tomkinson ..... F16B 13/124 411/63
822,131 A * 5/1906 Hyder ..... E06B 7/14 52/97
1,100,252 A * 6/1914 ONeill ..... F16B 15/06 411/456
1,123,090 A * 12/1914 Burnett ..... E04H 17/10 256/47
1,649,160 A * 11/1927 Fisher ..... F16B 13/124 411/63
1,795,279 A * 3/1931 McIntosh ..... F16B 13/124 411/61
1,918,936 A * 7/1933 Shearman ..... F16B 15/06 411/456
3,986,366 A * 10/1976 Dinsmore, Jr. ..... B63B 21/243 405/172
4,055,929 A * 11/1977 Stancati ..... E04B 1/4121 52/705

(Continued)

FOREIGN PATENT DOCUMENTS

CN 204676748 U 9/2015

*Primary Examiner* — Brian E Glessner
*Assistant Examiner* — Adam G Barlow
(74) *Attorney, Agent, or Firm* — Nath, Goldberg & Meyer; Richard C. Litman

(57) ABSTRACT

The hybrid post-installed anchor for concrete is a structural anchor for installation within a hole formed in concrete. The hybrid post-installed anchor for concrete includes an anchor rod and a plurality of anchor rings mounted on and encircling the anchor rod. Each anchor ring includes a cylindrical ring, having opposed open upper and lower ends, and a plurality of fins secured to an outer surface of the cylindrical ring. Each fin has a fixed edge, which is secured to the outer surface of the cylindrical ring, and a free edge. Each fin projects radially and upwardly, such that each fin is angled with respect to a common central axis of the anchor rod and each anchor ring when the anchor rings are mounted coaxially on the anchor rod. Alternatively, the fins may be formed integrally on the anchor rod, without separate cylindrical rings.

5 Claims, 7 Drawing Sheets

(56) References Cited

U.S. PATENT DOCUMENTS 4,508,319 A * 4/1985 Tappan ..... E04H 17/14 256/1
4,649,678 A * 3/1987 Lamson ..... E01F 15/0469 248/530
4,738,060 A * 4/1988 Marthaler ..... G01C 15/04 135/118
4,846,655 A * 7/1989 Gulley ..... F16B 15/06 411/453
4,926,785 A * 5/1990 Lamson ..... E04H 12/2215 116/209
5,226,829 A * 7/1993 Jones ..... E04H 15/62 135/118
5,230,597 A * 7/1993 Nuttall ..... E04H 17/10 411/453
5,463,834 A * 11/1995 Krieger ..... E02D 5/803 135/118
5,568,785 A * 10/1996 Hazen ..... E04H 12/2215 116/209
5,807,051 A * 9/1998 Heminger ..... F16B 13/141 411/82
6,098,361 A * 8/2000 Roten ..... E04H 12/2269 403/277
6,256,942 B1 * 7/2001 Schatz ..... E02D 5/803 135/118
6,461,084 B1 10/2002 Stuart
D503,842 S * 4/2005 Barnes ..... D99/18
6,886,296 B1 * 5/2005 John ..... E02D 5/60 248/519
6,941,710 B2 * 9/2005 Eden ..... E04C 3/30 248/354.1
7,357,366 B1 * 4/2008 White ..... A63B 71/023 248/156
7,517,182 B2 * 4/2009 Cabrele ..... F16B 13/061 411/80.5
8,534,273 B2 * 9/2013 LoRocco ..... F41B 5/1426 124/89
8,635,758 B2 * 1/2014 Slepecki ..... F16B 13/12 29/525.02
9,273,441 B2 * 3/2016 Hashim ..... E02D 5/80
9,447,574 B2 9/2016 Espinosa
D780,882 S * 3/2017 Barker ..... D22/199
9,677,296 B2 * 6/2017 Smith ..... E04H 12/347
10,260,252 B2 * 4/2019 Boswell ..... E04H 15/62
D856,788 S * 8/2019 Morey ..... D8/391
2004/0202512 A1 * 10/2004 Smith ..... E02D 5/80 405/259.1
2005/0091746 A1 * 5/2005 Clouston ..... E04H 15/62 5/417

* cited by examiner

HYBRID POST-INSTALLED ANCHOR FOR CONCRETE

BACKGROUND

1. Field

The disclosure of the present patent application relates to anchoring in concrete construction, and particularly to a hybrid post-installed anchor which supplements adhesive bonding with mechanical support.

2. Description of the Related Art

A post-installed anchor is a structural anchor which is installed in a hole that is drilled in hardened and cured concrete. The hole typically contains grout, adhesive or the like. Post-installed anchors are increasingly being used in reinforced concrete (RC) construction. These anchors can be used for extending existing walls, slabs and columns, as well as strengthening columns by increasing the column section and amount of steel reinforcement. Post-installed anchorage systems are typically formed from steel rods or reinforcing bars that are installed into a pre-dilled hole in hardened concrete. In recent years, the usage of adhesive anchors has become increasingly popular. Adhesive anchor systems typically have relatively short curing times, high load carrying capacities, and allow for precise installation and reduced installation time.

The material properties of the polymers used as adhesives are time dependent. As such, the polymer molecules begin to rearrange and slide past one another under sustained loads over time, thereby undermining the effectiveness of the adhesive. Thus, a hybrid post-installed anchor for concrete solving the aforementioned problems is desired.

SUMMARY

The hybrid post-installed anchor for concrete is a structural anchor for installation within a hole formed in concrete. The hybrid post-installed anchor for concrete includes an anchor rod and a plurality of fins connected to the rod. Each fin projects radially and upwardly, such that each fin is angled with respect to a common central axis of the anchor rod.

In an embodiment, the plurality of fins protrude from a plurality of anchor rings mounted on the anchor rod. Each anchor ring includes a cylindrical ring, having opposed open upper and lower ends. The plurality of fins are secured to an outer surface of the cylindrical ring. The plurality of fins may be welded to the cylindrical ring or may be cast integrally therewith. Each fin has a fixed edge, which is secured to the outer surface of the cylindrical ring, and a free edge. Each fin projects radially and upwardly, such that each fin is angled with respect to a common central axis of the anchor rod and each anchor ring when the anchor rings are mounted coaxially on the anchor rod. The anchor rod may be threaded for engaging corresponding threads formed on an inner surface of each cylindrical ring.

In an alternative embodiment, the plurality of fins are a plurality of sets of fins directly secured to the anchor rod. The plurality of sets of fins may be welded to the anchor rod or may be cast integrally therewith. Each set of fins is axially spaced apart from other ones of the plurality of sets of fins so that each set is circumferentially arrayed with respect to the anchor rod, and each set is positioned at a unique height of the anchor rod. Each fin of each set of fins is secured to an outer surface of the anchor rod. Each fin has a fixed edge, secured to the outer surface of the anchor rod, and a free edge. Each fin projects radially and upwardly, such that each fin is angled with respect to a central axis of the anchor rod.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
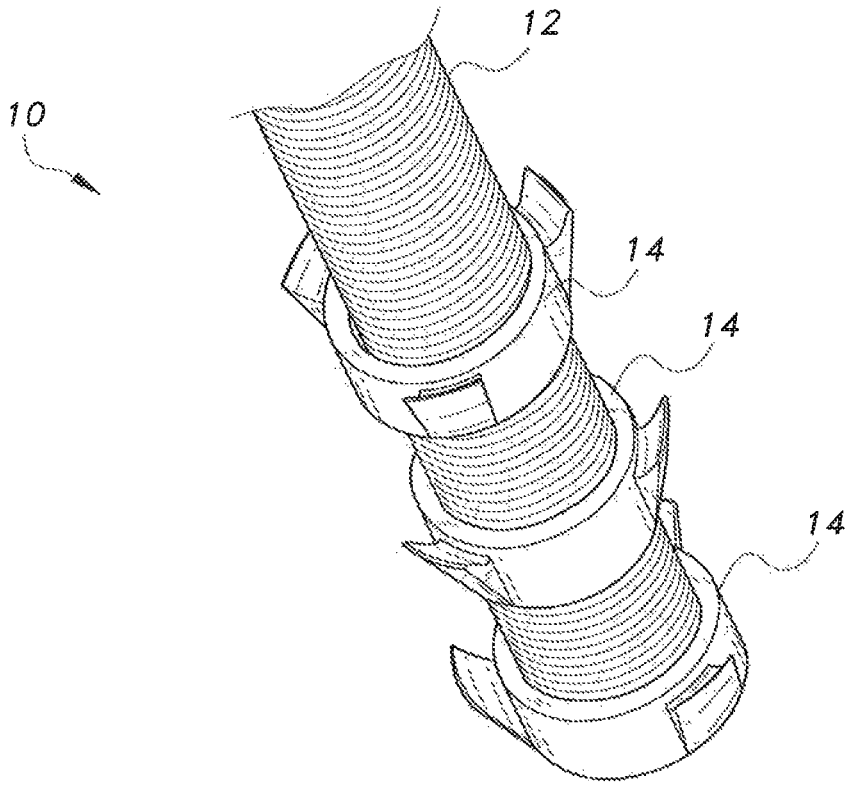
FIG. 1 is a perspective view of a hybrid post-installed anchor for concrete.

Referring now to FIG. 1, the hybrid post-installed anchor for concrete is a structural anchor for installation within a hole formed in concrete. The hybrid post-installed anchor for concrete includes an anchor rod and a plurality of upwardly-extending fins connected to the anchor rod. Each fin projects radially, such that each fin is angled with respect to a common central axis of the anchor rod.

Figure 2:
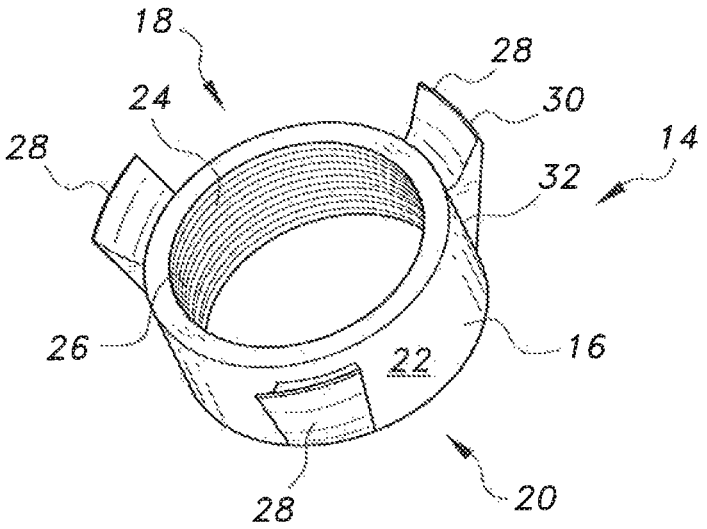
FIG. 2 is a perspective view of an anchor ring of the hybrid post-installed anchor for concrete.

An embodiment of the hybrid post-installed anchor for concrete, designated 10 in the drawings, includes an anchor rod 12 and a plurality of anchor rings 14 mounted on and encircling the anchor rod 12. As best shown in FIG. 2, each anchor ring 14 includes a cylindrical ring 16, having opposed open upper and lower ends 18, 20, respectively, and a plurality of fins 28 secured to an outer surface 22 of cylindrical ring 16. The plurality of fins 28 may be welded to the cylindrical ring 16 or may be cast integrally therewith.

Figure 3:
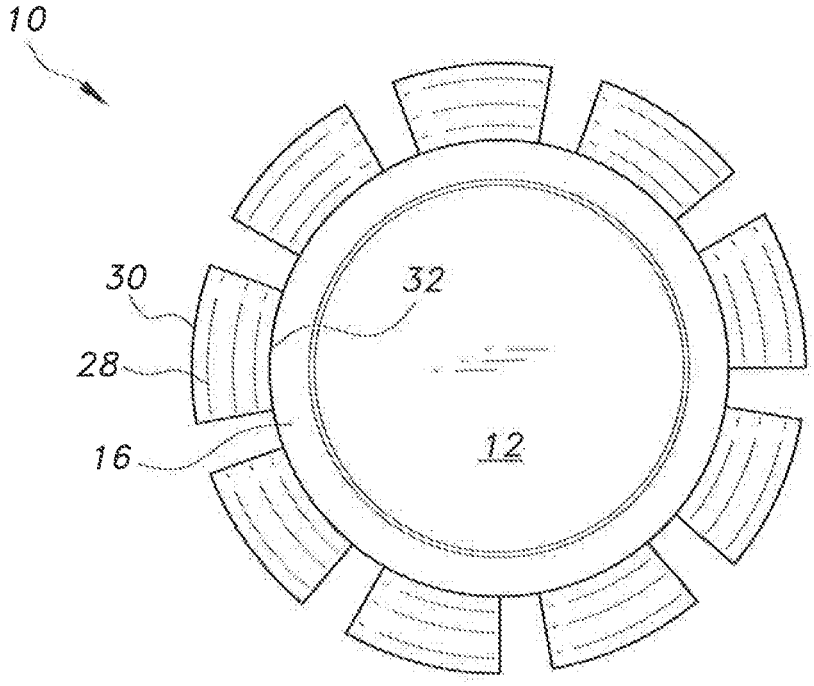
FIG. 3 is a bottom view of the hybrid post-installed anchor for concrete.
Figure 4:
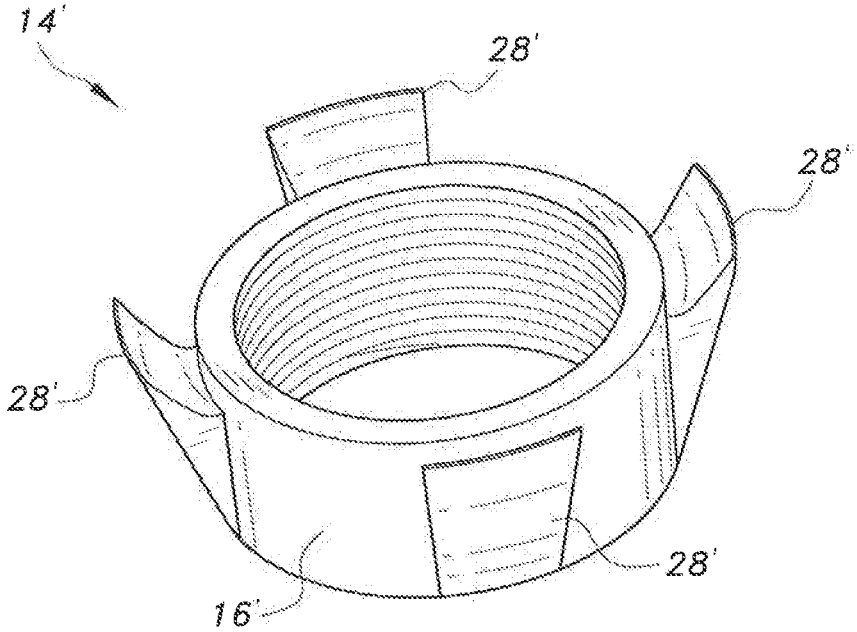
FIG. 4 is a perspective view of an alternative anchor ring of the hybrid post-installed anchor for concrete.

In FIG. 1, three such anchor rings 14 are shown mounted on anchor rod 12, however, it should be understood that the three anchor rings 14 are shown for exemplary purposes only, and that any suitable number of anchor rings 14 may be mounted on anchor rod 12. In FIG. 3, the same non-limiting example of three anchor rings 14 is used to illustrate that the plurality of fins 28 of each anchor ring 14 are angularly staggered with respect to the plurality of fins 28 of other ones of the plurality of anchor rings 14. Further, in FIGS. 1-3, each anchor ring 14 is shown as having three fins 28. It should be understood that any suitable number of fins may be used. As a non-limiting example, between two and six fins 28 may be included in each anchor ring 14. As an example, FIG. 4 shows an anchor ring 14' which has four such fins 28' secured to a cylindrical ring 16'. Additionally, returning to FIG. 1, the anchor rings 14 are shown as being equidistant from one another, with one anchor ring 14 being positioned at the bottom of anchor rod 12. It should be understood that in use, the axial spacing between adjacent anchor rings 14 may vary. Typically, the anchor rings 14 will be positioned close to the bottom of anchor rod 12, since the anchor rings 14 are more effective at deeper depths within the concrete hole.

Returning to FIGS. 2 and 3, each fin 28 has a fixed edge 32, which is secured to the outer surface 22 of the cylindrical ring 16, and a free edge 30. Each fin 28 projects radially and upwardly, such that each fin 28 is angled with respect to a common central axis of the anchor rod 12 and each anchor ring 14 when the anchor rings 14 are mounted coaxially on the anchor rod 12. As best shown in FIG. 3, each fin 28 increases in circumferential width from its fixed edge 32 to its free edge 30. Further, as best seen in FIG. 2, each fin 28 decreases in thickness from its fixed edge 32 to its free edge 30. As shown, the free edge 30, in addition to being relatively thin, may also be rounded. In use, the free edge 30 bends slightly when the post-installed anchor 10 is inserted into the hole. The profile of each fin 28 is such that the fin 28 deforms during insertion in order to prevent damage to the concrete. The bending of fins 28 is within the elastic limit of the fin material, such that it exerts pressure on the inside surface of the hole.

In use, the outer diameter of each anchor ring 14, defined y the diameter of the circular shape formed by the free edges 30, is slightly greater than the diameter of the concrete hole in which the post-installed anchor 10 is to be installed. However, it should be understood that the diameter of a concrete hole for anchoring in grout is typically larger than that of a concrete hole for anchoring in adhesive, thus the overall radial length of each fin 28 can be varied, dependent upon the particular type of material filling the hole. It should be further understood that the particular cross-sectional profile of each fin 28 is shown for exemplary purposes only and that the selected profile is dependent upon the force to be transmitted to the concrete, which will depend on the compressive strength of the particular type of concrete. The profile for each fin 28 may also vary dependent upon the depth of fins 28 in the hole.

As a non-limiting example, each fin may be angled between 30° and 75° with respect to the common central axis of the anchor rod 12 and each anchor ring 14. The direction of the projection of fins 28 is opposite to the direction of insertion of anchor rod 12 into the concrete hole. The specific angle is dependent upon the ratio of hole diameter to the diameter of anchor rod 12, the fin profile, and the concrete grade. Further, it should be understood that each fin 28 may be formed from any suitable type of material. As a non-limiting example, fins 28 may be formed from a shape memory alloy (SMA) or the like. Anchor rings 14 may be mounted on anchor rod 12 using any suitable technique. As a non-limiting example, the anchor rod 12 may be threaded, as shown in FIG. 1, for engaging corresponding threads 26 formed on an inner surface 24 of each cylindrical ring 16, as shown in FIG. 2.

Figure 7A:
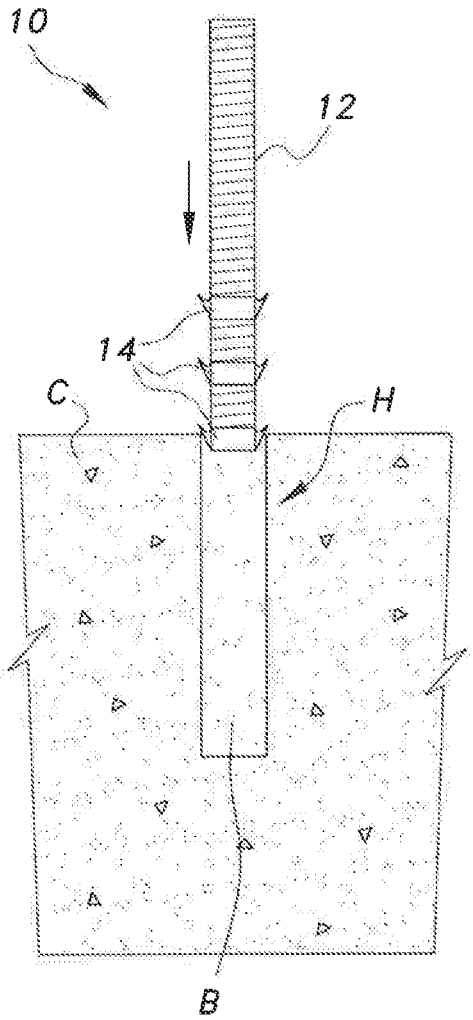
FIG. 7A and FIG. 7B diagrammatically illustrate installation of the hybrid post-installed anchor for concrete of FIG. 1 in a hole, filled with adhesive or grout, formed in concrete.
Figure 7B:
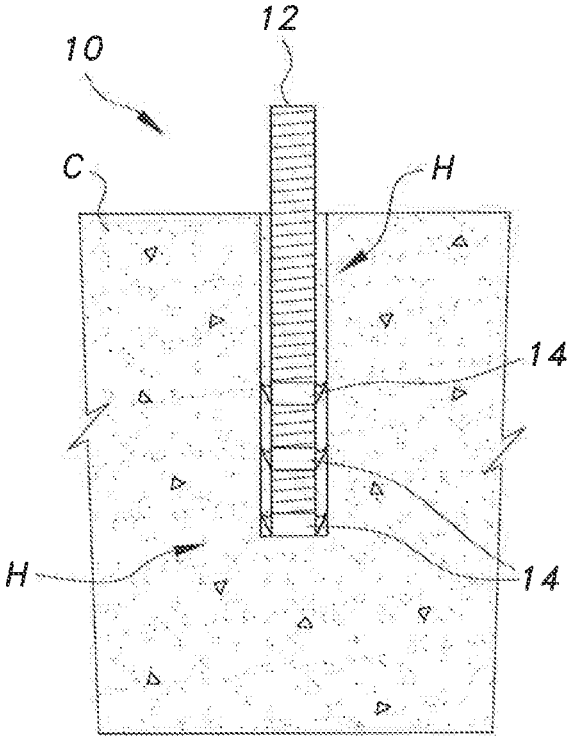

As shown in FIGS. 7A and 7B, in use, a hole H is initially drilled in concrete C, with the hole H being slightly bigger than the diameter of post-installed anchor 10, as required for either an adhesive or grouted anchor (i.e., the choice of material filling hole H). The depth of hole H in concrete C should correspond to the diameter of anchor rod 12, the strength of concrete C, and the type of adhesive or grout. Typically, the hole H is then cleaned with a wire brush, compressed air and/or a water jet or the like. The hole 11 is filled with a bonding material B, which may be adhesive, grout or the like. Anchor rod 12 is then inserted into hole H, and the adhesive or grout is cured before transferring a load to the post-installed anchor 10. In addition to the above, threads or corrugations may be cut in the concrete borehole to provide an interlocking surface for fins 28. It should be understood that the orientation of fins 28 in FIGS. 7A and 7B is shown for purposes of simplification and illustration only, and is not intended to accurately reflect the arrangement of fins 28, as shown in FIG. 1, for example.

Figure 5:
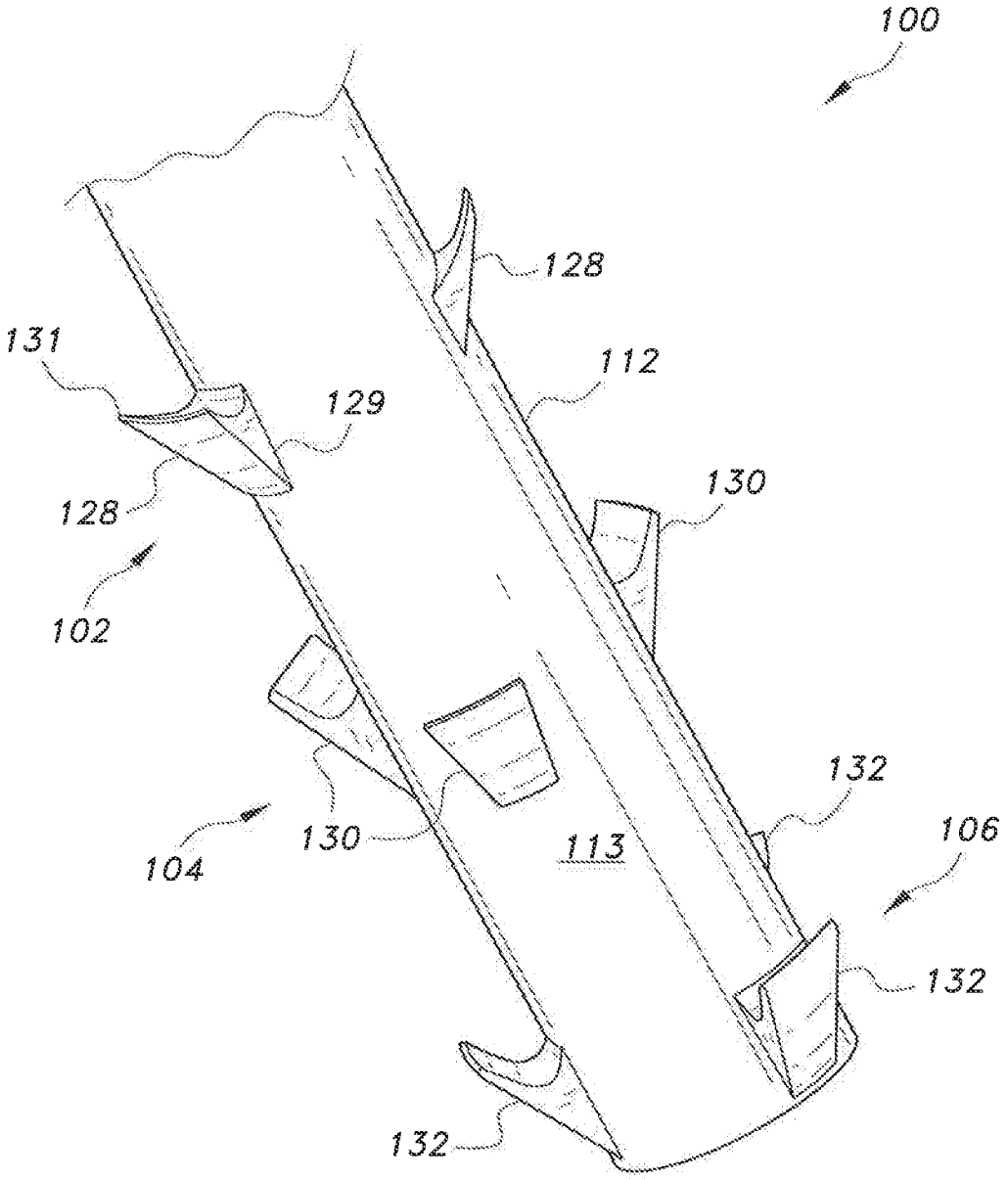
FIG. 5 is a perspective view of an alternative embodiment of the hybrid post-installed anchor for concrete.

In FIG. 5, an alternative hybrid post-installed anchor for concrete 100 is shown with a plurality of sets of fins 102, 104, 106 which are directly secured to the anchor rod 112. The plurality of sets of fins 102, 104, 106 may be welded to the anchor rod 112 or may be cast integrally therewith. As shown, each set of fins is axially spaced apart from other ones of the plurality of sets of fins 102, 104, 106 so that each set is circumferentially arrayed with respect to the anchor rod 112, and each set is positioned at a unique height of the anchor rod 112. Each fin of each set of fins 102, 104, 106 is secured to an outer surface 113 of anchor rod 112.

In FIG. 5, three sets of fins 102, 104, 106 are shown mounted on anchor rod 112, however, it should be understood that the three sets of fins 102, 104, 106 are shown for exemplary purposes only, and that any suitable number of sets of fins may be mounted on anchor rod 112. In the non-limiting example of FIG. 5, first set of fins 102 is shown including three fins 128, second set of fins 104 is shown including three fins 130, and third set of fins 106 is shown including three fins 132. It should be understood that any suitable number of fins may be used within each set of fins. As a non-limiting example, between two and six fins may be included in each set of fins. Additionally, in FIG. 5, the three sets of fins 102, 104, 106 are shown as being equidistant from one another, with the lowest set of fins 106 being positioned at the bottom of anchor rod 112. It should be understood that in use, the axial spacing between adjacent sets of fins may vary. Typically, however, the sets of fins will be positioned close to the bottom of anchor rod 112, since the fins are more effective at deeper depths within the concrete hole.

Figure 6:
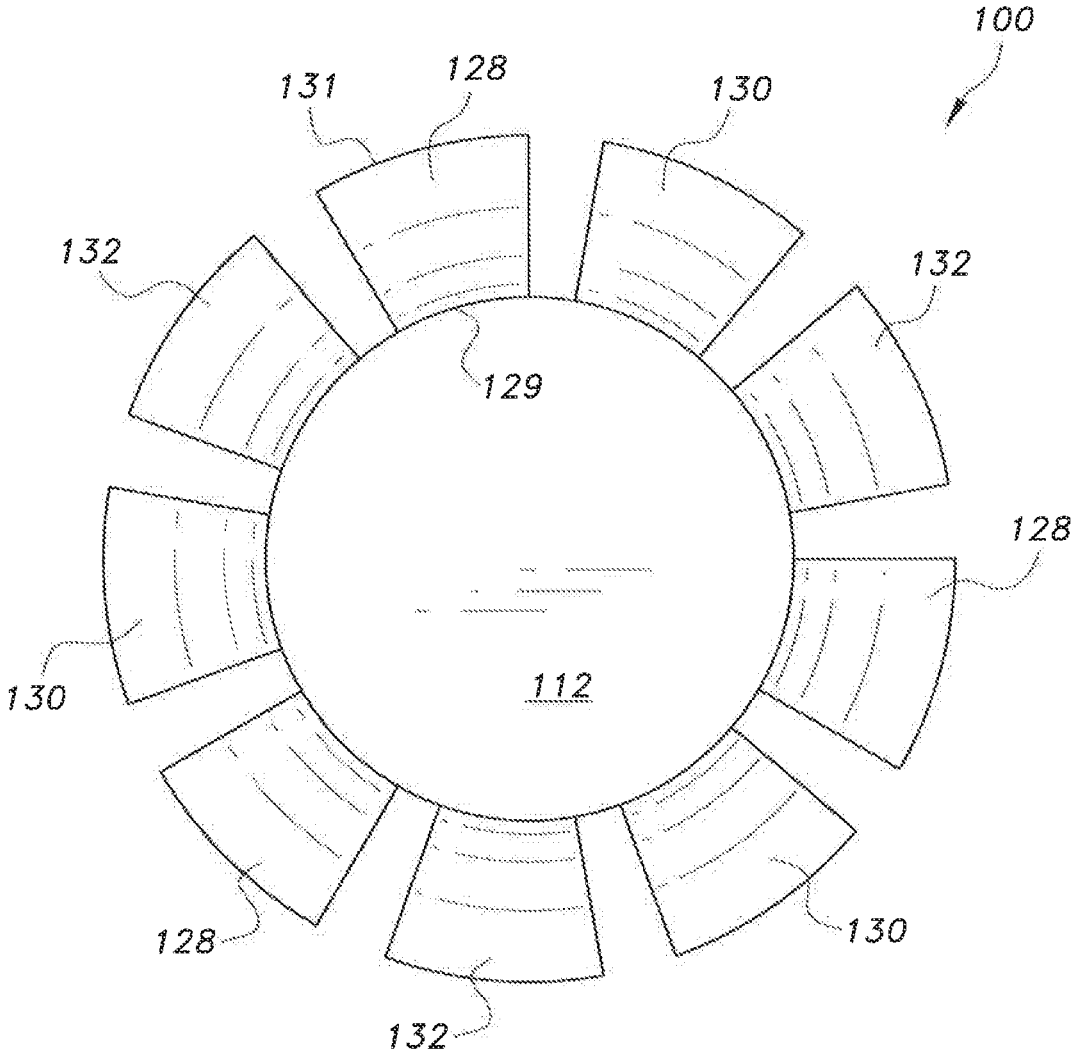
FIG. 6 is a bottom view of the hybrid post-installed anchor for concrete of FIG. 5.

In FIG. 6, the same non-limiting example of three sets of fins 102, 104, 106, each including three fins, is used to illustrate that the plurality of fins of each set of fins are angularly staggered with respect to the plurality of fins of other ones of the plurality of sets of fins. It should be understood that each of fins 128, 130, 132 is substantially identical. For purposes of simplification, the following discussion describes only one of fins 128. However, it should be understood that the following descriptions related to fins 128 apply to the fins of each set of fins.

As shown in FIGS. 5 and 6, each fin 128 has a fixed edge 129, which is secured to the outer surface 123 of the anchor rod 112, and a free edge 131. Each fin 128 projects radially and upwardly, such that each fin 128 is angled with respect to the central axis of the anchor rod 112. As best shown in FIG. 6, each fin 128 increases in circumferential width from its fixed edge 129 to its free edge 131. Further, as best seen in FIG. 5, each fin 128 decreases in thickness from its fixed edge 129 to its free edge 131. As shown, the free edge 131, in addition to being relatively thin, may also be rounded. In use, the free edge 131 bends slightly when the post-installed anchor 100 is inserted into the hole. The profile of each fin 128 is such that the fin 128 deforms during insertion in order to prevent damage to the concrete. The bending of fins 128 is within the elastic limit of the fin material, such that it exerts pressure on the inside surface of the hole.

In use, the diameter of the outer ring formed by each set of fins can be the same or slightly greater than the diameter of the concrete hole in which the post-installed anchor 100 is to be installed. However, it should be understood that the diameter of a concrete hole for anchoring in grout is typically larger than that of a concrete hole for anchoring in adhesive. Thus, the overall radial length of each fin 128 can be varied, dependent upon the particular type of material filling the hole. It should be further understood that the particular cross-sectional profile of each fin 128 is shown for exemplary purposes only and that the selected profile is dependent upon the force to be transmitted to the concrete, which will depend on the compressive strength of the particular type of concrete. The profile for each fin 128 may also vary dependent upon the depth of fins 128 in the hole.

As a non-limiting example, each fin 128 may be angled between 30° and 75 with respect to the central axis of the anchor rod 112. As in the previous embodiment, the direction of the projection of fins 128 is opposite to the direction of insertion of anchor rod 112 into the concrete hole. The specific angle is dependent upon the ratio of hole diameter to the diameter of anchor rod 112, the fin profile, and the concrete grade. Further, it should be understood that each fin 128 may be formed from any suitable type of material. As a non-limiting example, fins 128 may be formed from a SMA or the like. Embodiments having fins 128 made from SMA can be initially bent at room temperature such that the diameter of the ring formed by the outer/free edges of the fins is equal to the diameter of the concrete hole in which the anchor is to be installed. After the anchor rod is pushed into the hole, the heating of the anchor rod to a transformation temperature of the SMA can cause the fins to unbend and, thereby, exert pressure on the peripheral concrete. The adhesive bond as well as the mechanical interlock between the fins and the concrete surface can stabilize the anchor rod within the hole.

Figure 8A:
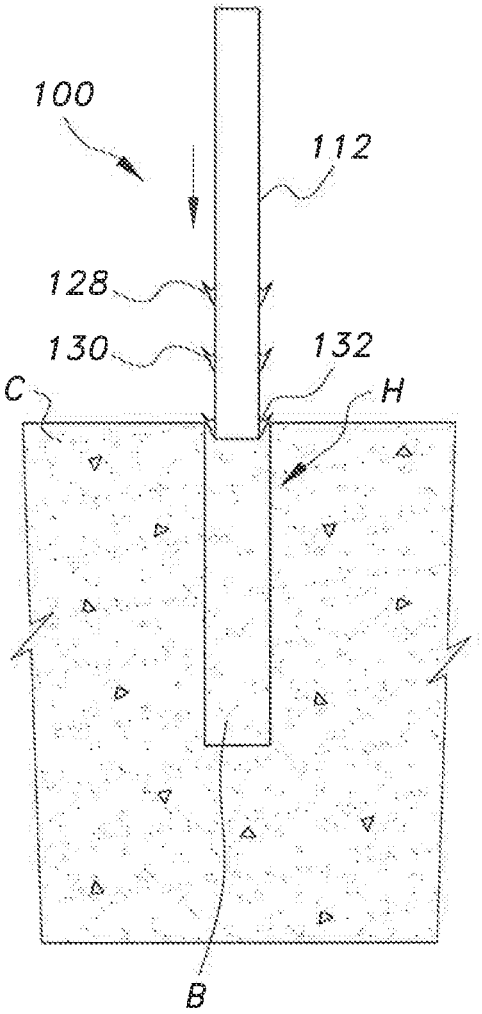
FIG. 8A and FIG. 8B diagrammatically illustrate installation of the hybrid post-installed anchor for concrete of FIG. 5 in a hole, filled with adhesive or grout, formed in concrete.
Figure 8B:
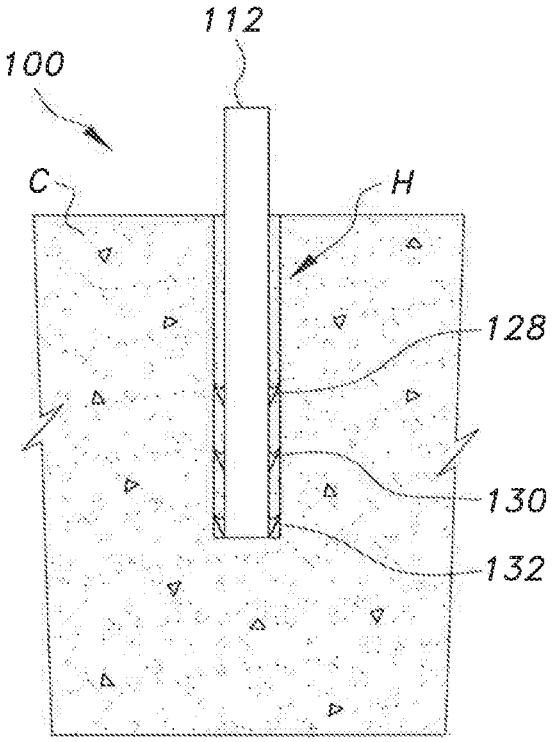

As shown in FIGS. 8A and 8B, in use, a hole H is initially drilled in concrete C. The depth of hole H in concrete C should correspond to the diameter of anchor rod 112, the strength of concrete C, and the type of adhesive or grout. Typically, the hole H is then cleaned with a wire brush, compressed air and/or a water jet or the like. The hole H is filled with a bonding material B, which may be adhesive, grout or the like. Anchor rod 112 is then inserted into hole H, and the adhesive or grout is cured before transferring a load to the post-installed anchor 100. In addition to the above, threads or corrugations may be cut in the concrete borehole to provide an interlocking surface for fins 128. It should be understood that the orientation of fins 128 in FIGS. 8A and 8B is shown for purposes of simplification and illustration only, and is not intended to accurately reflect the arrangement of fins 128, as shown in FIG. 5, for example.

Figure 9A:
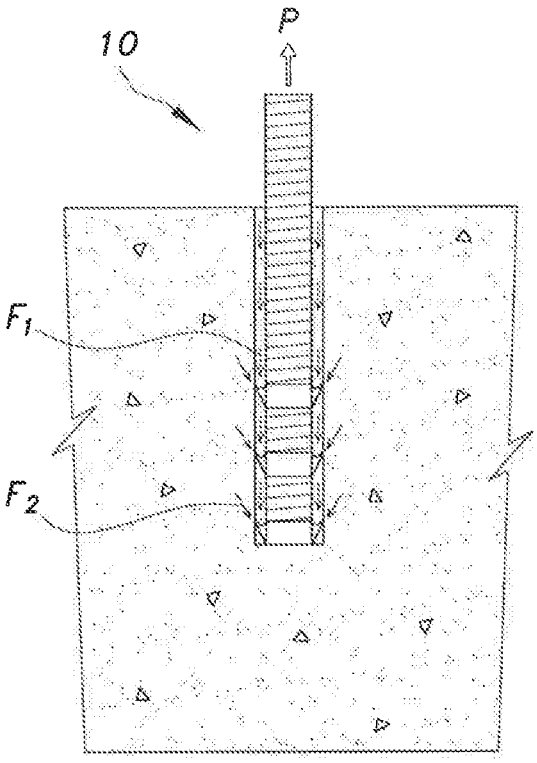
FIG. 9A schematically illustrates the mechanism of resistance to pull or the hybrid post-installed anchor for concrete of FIG. 1.
Figure 9B:
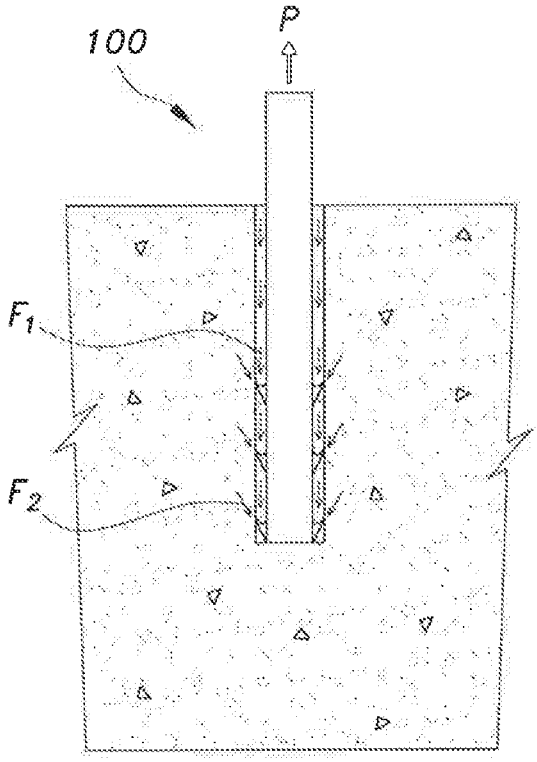
FIG. 9B schematically illustrates the mechanism of resistance to pull for the hybrid post-installed anchor for concrete of FIG. 5.

FIGS. 9A and 9B illustrate, respectively, the resistance mechanisms of post-installed anchors 10 and 100. Post-installed anchors 10 and 100 are hybrid types of post-installed anchors, that include both adhesive and mechanical bonding features. Due to the design of fins 28, 128, as described above, post-installed anchors 10 and 100 can be inserted into concrete holes with only a small push, but the fins 28, 128 offer resistance $F_2$ against pull P applied to the anchor rod. Thus, in addition to the anchor force $F_1$ resisted by the bond between the adhesive/grout and the anchor rod, as well as the concrete, the use of fins 28, 128 provides mechanical anchorage. Unlike a conventional adhesive anchor, which loses strength when exposed to high temperatures, the resistance $F_2$ provided by the mechanical anchorage between fins 28, 128 and the concrete remains effective, even upon exposure to extreme temperatures. The resistance provided by the mechanical anchorage can either be utilized in reducing the depth of the anchor or may be used as an extra safety measure in the event of fire exposure without requiring alteration of the depth of the anchor. Additionally, fins 28, 128 maintain the position of the anchor 10, 100 centered in the hole. This also helps in avoiding the deformation of adhesive under the action of shear force. It should be understood that the orientation of fins 28, 128 in FIGS. 9A and 9B, respectively, is shown for purposes of simplification and illustration only, and is not intended to accurately reflect the arrangement of fins 28, 128, as shown in FIGS. 1 and 5, for example.

As noted above, fins 28, 128 may be formed from a SMA. In this case, fins 28, 128 are initially bent at room temperature, such that the diameter defined by the fins' free edges is equal to the diameter of the concrete hole. After pushing the anchor rod 12, 112 into the hole, the anchor rod 12, 112 is heated to the transformation temperature of the SMA, which brings the fins 28, 128 back to their original unformed state, thus exerting pressure on the concrete walls of the hole.

It is to be understood that the hybrid post-installed anchor for concrete is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. A hybrid post-installed anchor for concrete, comprising:

an externally threaded elongated anchor rod, said anchor rod having a central axis and an axial length; and a plurality of anchor rings mounted on and encircling the anchor rod, wherein each said anchor ring comprises:

a cylindrical ring having opposed open upper and lower ends, wherein each ring is internally threaded for engagement with the threaded anchor rod; and a plurality of fins secured to an outer surface of the cylindrical ring, wherein each said fin:

i) has a fixed edge secured to the outer surface of the cylindrical ring and a free edge, ii) projects radially and upwardly, iii) each said fin being angled with respect to a common central axis of the anchor rod and each said anchor ring, iv) are angularly staggered with respect to the plurality of fins of other ones of the plurality of anchor rings, and v) is angled between 30° and 75° with respect to the common central axis of the anchor rod and each said anchor ring.

2. The hybrid post-installed anchor for concrete as recited in claim 1, wherein each said fin increases in circumferential width from the fixed edge thereof to the free edge thereof.

3. The hybrid post-installed anchor for concrete as recited in claim 1, wherein each said fin decreases in thickness from the fixed edge thereof to the free edge thereof.

4. The hybrid post-installed anchor for concrete as recited in claim 1, wherein the plurality of fins of each said anchor ring comprises between two and six of the fins.

5. The hybrid post-installed anchor for concrete as recited in claim 1, wherein each said fin is formed from a shape memory alloy.

* * * * *